US009051906B2

(12) United States Patent
Armesto et al.

(10) Patent No.: US 9,051,906 B2
(45) Date of Patent: Jun. 9, 2015

(54) DIESEL FUEL SYSTEM CONDITIONING

(75) Inventors: Carlos Armesto, Canton, MI (US); Scott J. Szymusiak, Canton, MI (US); Scott Donald Cooper, Ann Arbor, MI (US); Christopher Arnold Woodring, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 622 days.

(21) Appl. No.: 13/409,000

(22) Filed: Feb. 29, 2012

(65) Prior Publication Data

US 2013/0220280 A1 Aug. 29, 2013

(51) Int. Cl.

| | |
|---|---|
| ***F02M 37/04*** | (2006.01) |
| ***F02M 37/00*** | (2006.01) |
| ***F02M 37/10*** | (2006.01) |
| *F02M 37/22* | (2006.01) |

(52) U.S. Cl.

CPC ..... *F02M 37/0047* (2013.01); *F02M 2037/228* (2013.01); *F02M 37/22* (2013.01); *F02M 37/106* (2013.01)

(58) Field of Classification Search

CPC . F02M 37/106; F02M 37/103; F02M 37/025; F02M 37/22; F02M 37/10; F02M 37/0047; F02M 2037/228

USPC ..... 123/509, 510, 511, 514; 210/416.4

See application file for complete search history.

(56) References Cited

U.S. PATENT DOCUMENTS

| | | | | | |
|---|---|---|---|---|---|
| 4,454,851 | A * | 6/1984 | Bourbonnaud et al. | ..... | 123/557 |
| 4,478,197 | A * | 10/1984 | Yasuhara et al. | ..... | 123/514 |
| 4,625,701 | A * | 12/1986 | Bartlett et al. | ..... | 123/514 |
| 4,893,603 | A * | 1/1990 | Siebels | ..... | 123/514 |
| 5,085,198 | A * | 2/1992 | Bartlett et al. | ..... | 123/510 |
| 5,103,793 | A * | 4/1992 | Riese et al. | ..... | 123/516 |
| 5,231,967 | A * | 8/1993 | Baltz et al. | ..... | 123/497 |
| 5,413,711 | A | 5/1995 | Janik | | |
| 5,520,156 | A * | 5/1996 | Brunnhofer | ..... | 123/516 |
| 5,605,133 | A * | 2/1997 | Tuckey | ..... | 123/458 |
| 5,762,047 | A * | 6/1998 | Yoshioka et al. | ..... | 123/509 |
| 5,809,975 | A | 9/1998 | Tuckey et al. | | |
| 5,832,717 | A * | 11/1998 | Halin | ..... | 60/39.281 |
| 6,234,151 | B1 * | 5/2001 | Eck | ..... | 123/514 |
| 6,253,740 | B1 * | 7/2001 | Rembold | ..... | 123/509 |
| 6,712,590 | B1 * | 3/2004 | Villela et al. | ..... | 417/423.9 |
| 6,729,309 | B2 * | 5/2004 | Schueler | ..... | 123/514 |
| 6,752,130 | B2 * | 6/2004 | Schueler et al. | ..... | 123/514 |
| 7,044,110 | B2 * | 5/2006 | Geyer | ..... | 123/514 |
| 7,082,931 | B2 * | 8/2006 | Sinz | ..... | 123/509 |
| 7,192,518 | B2 * | 3/2007 | Roesgen | ..... | 210/149 |

(Continued)

FOREIGN PATENT DOCUMENTS

JP 2003176761 A 6/2003

*Primary Examiner* — Thomas Moulis

(74) *Attorney, Agent, or Firm* — Julia Voutyras; Alleman Hall McCoy Russell & Tuttle LLP

(57) ABSTRACT

Methods and systems are provided for conditioning fuel for diesel engine. The system may include a fuel pump located within a fuel tank configured to pump fuel to the diesel engine. The system may also include a fuel filter located outside of the fuel tank operatively located upstream of a flow of fuel from the fuel pump. A method may include directing fuel from inside of the fuel tank through a fuel filter located outside of the fuel tank into a vacuum chamber positioned inside the fuel tank, before directing the fuel to the diesel engine.

23 Claims, 2 Drawing Sheets

(56) References Cited

U.S. PATENT DOCUMENTS

| | | | | |
|---|---|---|---|---|
| 7,493,893 | B2 * | 2/2009 | Funabashi et al. | 123/497 |
| 7,793,642 | B2 | 9/2010 | Yonemoto et al. | |
| 7,926,470 | B2 * | 4/2011 | Lockridge et al. | 123/510 |
| 7,954,477 | B2 * | 6/2011 | Gruber et al. | 123/514 |
| 8,205,596 | B2 * | 6/2012 | Kieferle et al. | 123/446 |
| 8,220,437 | B2 * | 7/2012 | Yamada et al. | 123/509 |
| 8,251,046 | B2 * | 8/2012 | Brown et al. | 123/456 |
| 8,286,802 | B2 * | 10/2012 | Leppert | 210/416.4 |
| 8,371,267 | B2 * | 2/2013 | Kristen et al. | 123/446 |
| 2009/0000844 | A1 * | 1/2009 | Castillo et al. | 180/69.4 |
| 2009/0151699 | A1 | 6/2009 | Honda et al. | |
| 2009/0217911 | A1 * | 9/2009 | Yokura et al. | 123/457 |
| 2009/0277424 | A1 | 11/2009 | Yonemoto et al. | |
| 2012/0132178 | A1 * | 5/2012 | Ziegler et al. | 123/509 |

* cited by examiner

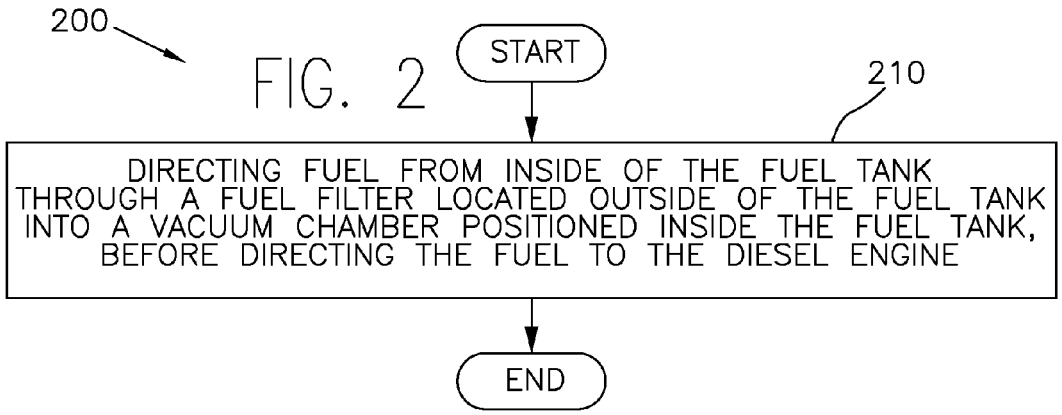
200
FIG. 2
START
210
DIRECTING FUEL FROM INSIDE OF THE FUEL TANK THROUGH A FUEL FILTER LOCATED OUTSIDE OF THE FUEL TANK INTO A VACUUM CHAMBER POSITIONED INSIDE THE FUEL TANK, BEFORE DIRECTING THE FUEL TO THE DIESEL ENGINE
END

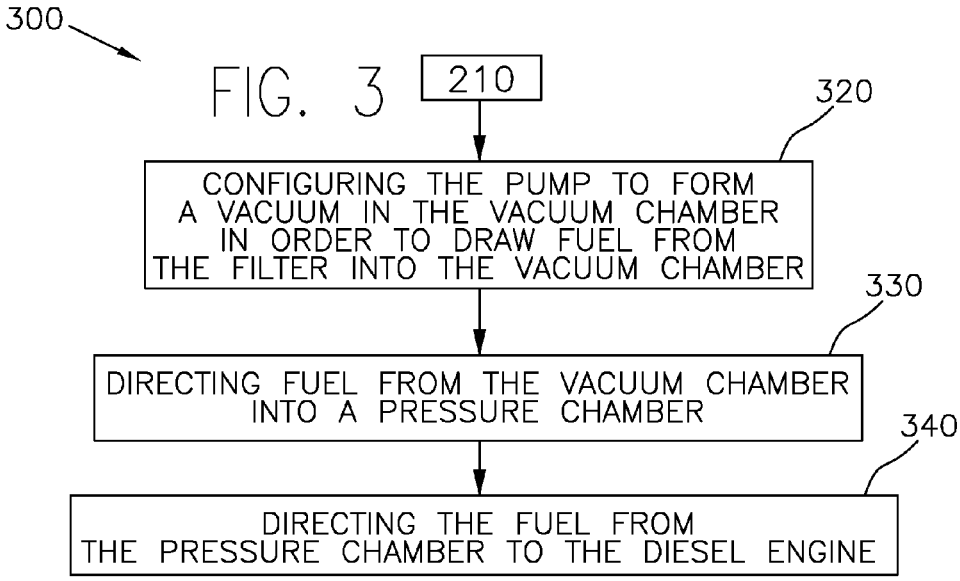
300
FIG. 3
210
320
CONFIGURING THE PUMP TO FORM A VACUUM IN THE VACUUM CHAMBER IN ORDER TO DRAW FUEL FROM THE FILTER INTO THE VACUUM CHAMBER
330
DIRECTING FUEL FROM THE VACUUM CHAMBER INTO A PRESSURE CHAMBER
340
DIRECTING THE FUEL FROM THE PRESSURE CHAMBER TO THE DIESEL ENGINE

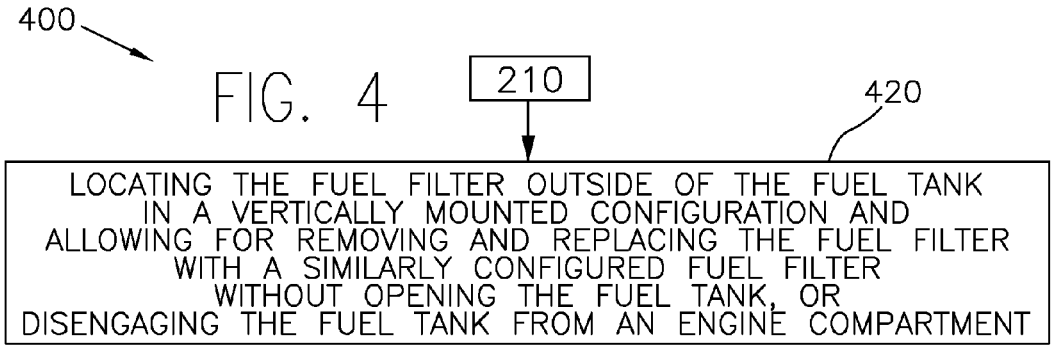
400
FIG. 4
210
420
LOCATING THE FUEL FILTER OUTSIDE OF THE FUEL TANK IN A VERTICALLY MOUNTED CONFIGURATION AND ALLOWING FOR REMOVING AND REPLACING THE FUEL FILTER WITH A SIMILARLY CONFIGURED FUEL FILTER WITHOUT OPENING THE FUEL TANK, OR DISENGAGING THE FUEL TANK FROM AN ENGINE COMPARTMENT

DIESEL FUEL SYSTEM CONDITIONING

FIELD

The present application relates to methods and systems for conditioning the fuel of a diesel engine, specifically methods and systems wherein a filter is located upstream of a low pressure fuel pump and which is located outside of the fuel tank.

BACKGROUND AND SUMMARY

Vehicle engines may be configured to operate using diesel fuels. Diesel fuel delivery and diesel fuel conditioning systems typically include a low pressure, or feed, pump functionally located with the fuel tank, and a high pressure pump functionally located relatively spaced from the fuel tank. There is also, typically, at least one fuel filter arranged to filter out particles which may be in the diesel fuel. It is common to locate the fuel filter downstream of the fuel pump. However, this creates the disadvantage in that "dirty" fuel may be passed through the pump. One such example is disclosed in U.S. Pat. No. 7,793,642 to Yonemoto et al.

JP 2003-176761 discloses an alternative wherein a fuel filter is located on the upstream side of the low pressure pump. However this arrangement includes the common shortcoming in that the filter is located within the fuel tank thereby requiring the tank to be emptied, and drained, before the filter can be extracted from the fuel tank for cleaning or replacement and the like. It is also common that downstream filters be located inside the fuel tank. This, of course, also requires draining and opening of the tank for removal and/or replacement of the filter.

The inventors have recognized several potential issues with these approaches. For example, downstream filters do not protect the pump adequately. Is addition, a great many pump warranty claims are caused by plugged filters. Many times when a filter is clogged, the whole Diesel Fuel Conditioning Module (DFCM) is replaced rather than the just the filter. This, of course, is more expensive than warranted.

Various embodiments may be configured to provide a diesel fuel conditioning system for a diesel engine which may include a fuel pump located within a fuel tank configured to pump fuel to the diesel engine, and a fuel filter located outside of the fuel tank operatively located upstream in a flow of fuel from the fuel pump. In this way the fuel pump may be protected from particles in the fuel; fuel filter replacement may be easier; and may result in lower warranty cost.

Various embodiments may also be configured to provide a diesel fuel conditioning system for a diesel engine which may include a fuel tank, a fuel filter located outside of the fuel tank; and a vacuum chamber coupled with a pressure chamber via a fuel pump located within the fuel tank. The fuel pump may be configured to pull fuel from the fuel tank through the fuel filter and into the vacuum chamber. In this way various embodiments may provide an in-tank pump that may be configured to suck fuel through the externally mounted filter and back to the tank reservoir. This may allow the dirty fuel in the tank to pass through a standard filter or a customized filter that may be capable of reducing debris down to, for example, 10 microns or less before entering the pump.

Another issue the inventors have recognized is that low pressure pumps may sometimes cause vibrations which may create excess noise and/or mechanical fatigue in the system. Embodiments in accordance with the current disclosure may include a pressure chamber that may be is used to dampen vibration of the pump's pressure spikes.

The pressure chamber may also provide a mechanism to separate the air at the tank. The mechanism to separate the air may include an air bleed valve configured to allow air to escape from the pressure chamber, and therefore from the fuel stream, before being directed to the engine.

Yet another issue that various embodiments may be configured to address is the presence water in the fuel which may otherwise be emulsified by the action of the pump. Emulsified water is undesirable in that it may be passed to the engine combustion chamber in the fuel. The external filter in accordance with the current disclosure may include a water separation reservoir configured to capture water separated from the fuel, as the fuel passes through the filter, before the fuel passes through the pump.

Another issue with diesel fuel filters, in particular at low ambient temperatures, such as during an engine cold-start, is that wax may precipitate out of the diesel fuel. The precipitated wax may clog a fuel filter while also reducing the fluidity of the fuel. The amount of wax that precipitates from the fuel may depend upon the fuel properties and ambient temperature the vehicle is started in. As such, the precipitated wax in the fuel reduces the pressure of the low pressure fuel system and performance of the high pressure fuel system and, if severe enough, can cause damage to the fuel system. Various embodiments may provide a fuel recirculation valve configured to selectively direct at least of portion of fuel returned from the engine to the filter. In this way fuel heated by being passed through portions of the engine, i.e. through an engine fuel rail, may be selectively passed through the filter in order to melt wax that may have accumulated in the filter.

In one example, some of the above issues may be addressed by a method for a fuel conditioning module of a diesel engine including directing fuel from inside of the fuel tank through a fuel filter located outside of the fuel tank into a vacuum chamber positioned inside the fuel tank, before directing the fuel to the diesel engine.

In one example the method for a fuel conditioning module of a diesel engine may include configuring the pump to form a vacuum in the vacuum chamber in order to draw fuel from the filter into the vacuum chamber. The method may also include directing fuel from the vacuum chamber into a pressure chamber and then directing the fuel from the pressure chamber to the diesel engine.

In another example the method for a fuel conditioning module of a diesel engine may include locating the fuel filter outside of the fuel tank in a vertically mounted configuration and allowing for removing and replacing the fuel filter with a similarly configured fuel filter without opening the fuel tank, or disengaging the fuel tank from an engine compartment.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows a high level flow chart for a method for a fuel conditioning module that may be used for the diesel engine fuel system of FIG. 1.

FIG. 3 shows a high level flow chart for another method for a fuel conditioning module that may be used for the diesel engine fuel system of FIG. 1.

FIG. 4 shows a high level flow chart for yet another method for a fuel conditioning module that may be used for the diesel engine fuel system of FIG. 1.

DETAILED DESCRIPTION

Figure 1:
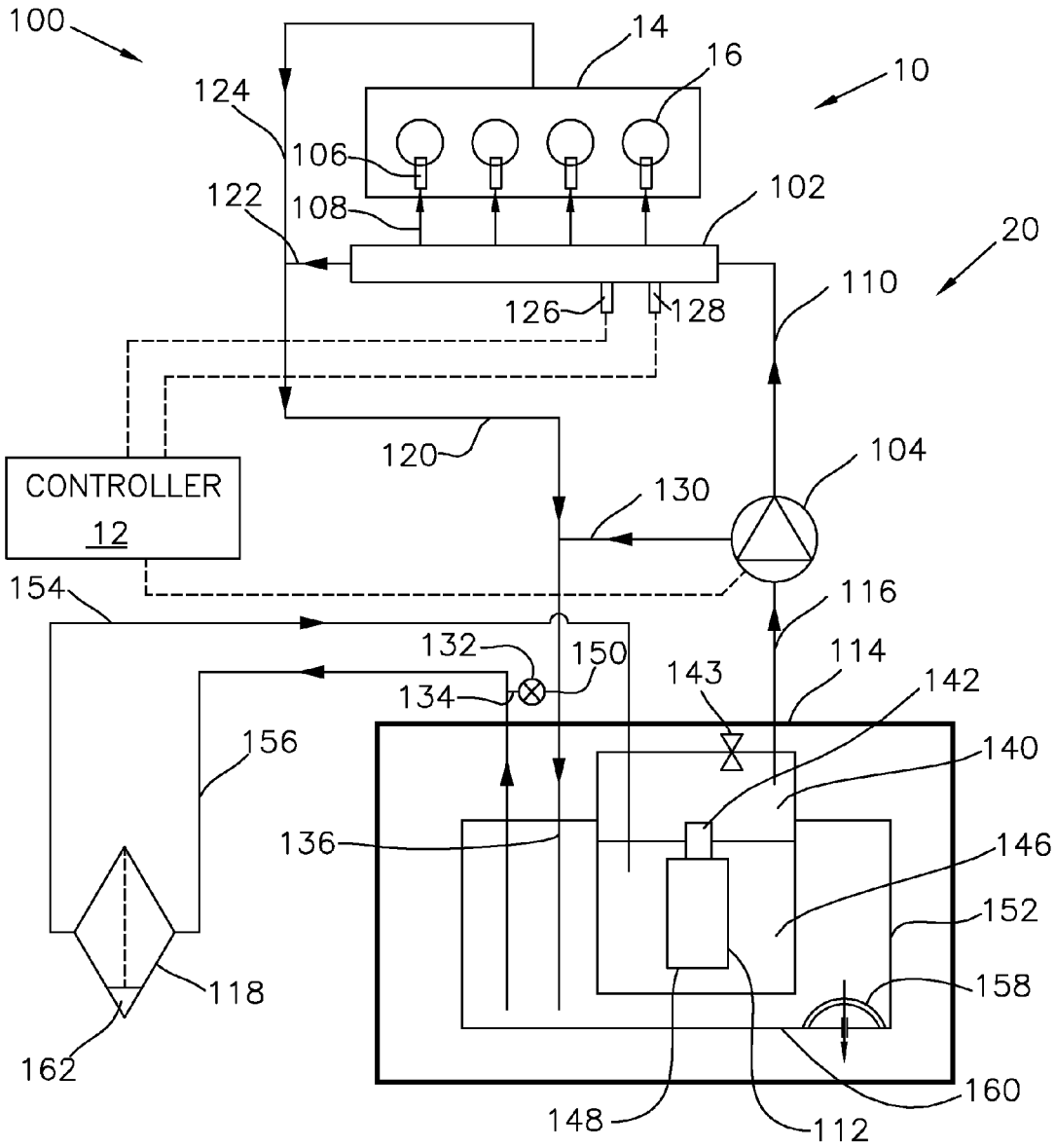
FIG. 1 shows an example vehicle system layout, including details of a fuel system.

The following description relates to systems and methods for diesel fuel conditioning. FIG. 1 depicts an example vehicle system 100. In the depicted embodiment, vehicle system 100 is a diesel-fuelled vehicle system. The driving force of the vehicle system 100 may be generated by engine 10. Engine 10 may include one or more two banks 14. One bank 14 is indicated in the current example showing four cylinders 16. While engine 10 is shown as a 4-cylinder, four-stroke engine, it will be appreciated that the engine may have a different cylinder configuration (for e.g., in-line, V-shaped, or opposed) and/or a different number of cylinders (e.g., six, or eight).

Engine 10 of the vehicle system 100 may include a fuel system 20. Fuel system 20 may include a fuel rail 102, a supply pump 104, and fuel injectors 106. Fuel rail 102 may provide a chamber for holding fuel for subsequent injection into cylinders 16 through fuel injectors 106. In the depicted example, the fuel rail 102 may provide pressurized fuel to fuel injectors 106 of the bank 14 along high-pressure injector passages 108. Fuel rail 102 may include one or more fuel rail pressure sensors/switches 126 for sensing fuel rail pressures ($P_{fuel_rail}$) and one or more fuel rail temperature sensors 128 for sensing fuel rail temperatures ($T_{fuel_rail}$) and communicating the same with an engine controller 12. Only one fuel rail pressure sensor/switch 126 and one fuel rail temperature sensor 128 is shown for simplicity. Additional fuel rail pressure regulators may also be included. In the depicted example, fuel injectors 106 may be of the direct injection type, although it will be appreciated that they may alternately be of the port injection type. Further still, each cylinder 16 may include more than one injector, some of the injectors being of the direct injection type while others are of the port injection type.

Fuel may be pressurized by supply pump 104 and transferred to the fuel rail 102 along high-pressure rail passage 110. In one example, supply pump 104 may be driven by the rotation of engine 10, such as by an engine crankshaft and/or an engine camshaft. Alternatively, supply pump 104 may be driven by an optional electric motor.

A low pressure feed pump 112 may be configured to draw low-pressure fuel from fuel tank 114 and feed it into supply pump 104 for subsequent pressurization and injection. In one example, fuel tank 114 may include a fuel type sensor (not shown) for determining a type of fuel in the tank. Low pressure fuel drawn by feed pump 112 may be transferred to supply pump 104 along low pressure passage 116.

Fuel rail 102 may also be configured to return fuel, and thereby reduce fuel pressure, into low pressure recirculation passage 120 via rail return flow passage 122. A pressure reducing valve at the rail outlet (not shown) may regulate the return flow of fuel from the fuel rail into recirculation passage 120. Similarly, fuel returned from injectors 106 may also be fed into recirculation passage 120 via injector return flow passage 124. Supply pump 104 may also be configured to return fuel, and thereby reduce fuel pressure into recirculation passage 120 via pump return flow passage 130. A pressure reducing valve at the pump's outlet (not shown) may regulate the return flow of fuel from the supply pump into the recirculation passage 120. As such, the fuel returned from the supply pump, injectors, and/or rail may hereinafter also be referred to as the return fuel.

The diesel fuel conditioning system 100 for a diesel engine shown in FIG. 1 may include a fuel pump 112 located within a fuel tank 114. The fuel pump 112 may be referred to as a feed pump 112, or a low pressure pump 112. The pump 112 may be configured to pump fuel to the diesel engine 10. The system 100 may also include a fuel filter 118 located outside of the fuel tank 114 operatively located upstream of a flow of fuel from the fuel pump 112. The fuel pump 112 may be located on a clean side of the filter 118 in that the fuel exiting the filter 118 may be considered cleaned by the filter. The particles removed may be, for example, on the order of, for example, 10 microns or less.

The diesel fuel conditioning system 100 may also include a pressure chamber 140 located at an outlet 142 of the fuel pump 112. The pressure chamber 140 may have a bleed orifice 143 that may be configured to bleed air from the flow of fuel.

The diesel fuel conditioning system 100 may also include a vacuum chamber 146 located at an inlet 14 of the fuel pump 112 that may be configured to have a negative pressure relative to the fuel filter 118 to pull the flow of fuel from the fuel filter 118 into the vacuum chamber 146.

Embodiments of the diesel fuel conditioning system 110 may include a fuel tank 114, and a fuel filter 118 located outside of the fuel tank 114. The system 100 may also include a vacuum chamber 146 coupled with a pressure chamber 140 via a fuel pump 112 located within the fuel tank 114. The fuel pump 112 may be configured to pull fuel from the fuel tank 114 through the fuel filter 118 and into the vacuum chamber 146.

The fuel pump 112 may be further configured to direct fuel to the diesel engine 10 via the pressure chamber 140. The pressure chamber 140 may have a bleed orifice 143 configured to bleed air from the fuel which passes through the pressure chamber 140.

The system 100 may also include a fuel path 120 wherein the fuel is directed from the engine via a fuel return passage 120 into the fuel tank 114, then directed out of the fuel tank 114 through the fuel filter 118 and into the vacuum chamber 146. The fuel path 120 may include a branch 150 coupled with the fuel return passage 120 wherein the fuel is able to be directed through the fuel filter 118 before being directed to the vacuum chamber 146.

Embodiments may provide a diesel fuel conditioning arrangement 100 of a diesel engine 10 which may include a fuel tank 114, a fuel filter 118 located outside of the fuel tank 114, and a pump 112 located inside the fuel tank 114 and configured to pull fuel through the fuel filter 118 and into the fuel tank 114, and to direct the fuel to the diesel engine 10.

The diesel fuel conditioning arrangement 100 may include a vacuum chamber 146 located at an inlet 148 of the pump 112 and a pressure chamber 140 located at an outlet 142 of the pump 112. In this way the pressure chamber 140 may be configured to dampen vibrations of the pump 112. The pressure chamber 140 may have a passage 116 for directing the fuel to the diesel engine 10 and an air bleed orifice 143 configured to allow air to be expelled from the pressure chamber such that the expelled air is not directed to the diesel engine 10. In some cases the expelled air may be at least partly used to power a jet pump or other device (not shown).

The diesel fuel conditioning arrangement 100 may also include a fuel reservoir 152 located inside the fuel tank 114. The pump 112 may be located substantially within the fuel reservoir 152. The vacuum chamber 146 may be located at an inlet 148 of the pump 112 and the pressure chamber may be located at an outlet 142 of the pump, all substantially within the fuel reservoir 152. A filter outlet passage 154 may be configured to allow fuel to pass from the filter 118 to the vacuum chamber 146. A filter inlet passage 156 may be configured to allow fuel to pass from the fuel reservoir 152 into the filter 118.

An umbrella valve 158 may be located in a wall 160 of the fuel reservoir 152. The umbrella valve 158 may be configured to regulate a difference in pressure between the reservoir 152 and the inside of the fuel tank 114 and to selectively allow fuel to pass there between.

The arrangement 100 illustrated may include a fuel recirculation valve 134. The fuel recirculation valve 134 may be configured to selectively direct at least of portion of fuel returned from the engine 10 to the filter 118.

In accordance with various embodiments of the diesel fuel conditioning arrangement 100 the pump 112 may be a low pressure pump on the clean side of the fuel filter 118. The fuel filter 118 may be able to be removed and replaced with a similarly configured fuel filter without opening the fuel tank 114 or disengaging the fuel tank 114 from the engine compartment. In some cases the pump 112 may be a vertically mounted pump. In other cases it may be mounted in other orientations.

The fuel filter 118 may include a water reservoir 162 which may be configured to collect water from the fuel that passes through the filter 118. In some cases the fuel filter 118 may be a box filter. In some cases the fuel filter 118 may be substantially cylindrically shaped.

In some embodiments, a return flow valve may be included at the outlet of the injectors to regulate the flow of injector return fuel into the recirculation passage. In alternate embodiments, a throttle may be used to regulate the flow of injector return fuel into the recirculation passage. A fuel cooler (not shown) may be optionally included in recirculation passage 120 for cooling the return fuel.

While the depicted example shows a single fuel filter, in alternate embodiments two or more filters may be included. Each filter may receive return fuel from respective recirculation branch passages. In one example, flow through each passage may be regulated by respective thermal recirculation valves. A pressure of fuel at the filter may be communicated to the engine controller 12 by a filter pressure sensor/switch (not shown) positioned at the outlet of the filter. Additional sensors, such as a fuel temperature sensor may also be included.

Feed pump 112, low pressure passage 116, recirculation passage 120, recirculation branch passage 132, return flow passages 122, 124, 130, first fuel filter 118 and thermal recirculation valve 134 may constitute a low pressure section of the fuel system 20. Similarly, supply pump 104, supply passages 110, 108, fuel rails 102 and injectors 106 may constitute a supply section of the fuel system 20.

Engine controller 12 may be coupled to various sensors and may be configured to receive a variety of sensor signals from the various sensors. The sensors may include a vehicle speed sensor, a throttle opening-degree sensor, an engine rotational speed sensor, a battery state of charge sensor, an ignition switch sensor, a brake switch sensor, a gear sensor, a driver request sensor, various temperature sensors, including engine coolant temperature sensor, fuel rail temperature sensor 128, a fuel rail pressure regulator, intake temperature sensor, exhaust temperature sensor, and various pressure sensors/switches, including a fuel rail pressure sensor/switch 126 and a filter pressure sensor/switch. The engine controller 12 may also be coupled to various actuators of the vehicle system and may be further configured to control the operation of the various actuators, including the fuel injectors 106, supply pump 104, and thermal recirculation valve 134.

In diesel-fuelled engines, wax may precipitate out of the fuel at low temperature, such as experienced during an engine cold-start. In such a case, fuel filter 118 may get clogged, thereby reducing fuel fluidity. In severe cases, supply pump damage and engine stalls may ensue. To address wax build-up and maintain fuel fluidity, return fuel (that is, fuel pressurized by supply pump and returned from the supply pump, injectors and/or fuel rail) may be re-circulated into the inlet of fuel filter 118. As such, during pressurization, the fuel may also get rapidly heated. Thus, by recirculating heated return fuel through the fuel filter, wax removal at the filter may be expedited and potential issues related to wax build-up at the filter may be addressed.

Specifically during recirculation, the heated return fuel may be returned to recirculation passage 120, from where it may be re-circulated into the inlet of fuel filter 118 through recirculation branch passage 120. A thermal recirculation valve 134 may regulate the return fuel flow and direct it to the fuel filter 118. The remaining return fuel may be returned to fuel tank 114 along return conduit 136. In one example, the thermal recirculation valve 134 may be fully opened at lower fuel temperatures and all the return fuel may be re-circulated, while at higher fuel temperatures, the thermal recirculation valve 134 may be fully closed and all the return fuel may be returned to the fuel tank. In another example, the thermal recirculation valve 134 may only be partially opened, such that at least some return fuel is recirculated. The engine controller 12 may regulate flow through the recirculation valve 134 by adjusting a degree of opening of the thermal recirculation valve 134 and/or duration of opening of the thermal recirculation valve 134, responsive to the fuel temperature and/or pressure.

FIG. 2 is a flow diagram which shows an example method 200 for a fuel conditioning module of a diesel engine which may be accomplished using the fuel system described above. At 210, method 200 may include directing fuel from inside of the fuel tank through a fuel filter located outside of the fuel tank into a vacuum chamber positioned inside the fuel tank, before directing the fuel to the diesel engine.

FIG. 3 is a flow diagram which shows example variation of the method illustrated in FIG. 2. The method 300 may include at 320, configuring the pump to form a vacuum in the vacuum chamber in order to draw fuel from the filter into the vacuum chamber. The method 300 may also include at 330, directing fuel from the vacuum chamber into a pressure chamber and then at 340, directing the fuel from the pressure chamber to the diesel engine. In this way the fuel may be filtered before flowing through the pump which may add to the effectiveness and longevity of the pump.

FIG. 4 is a flow diagram which shows another example variation of the method illustrated in FIG. 2. The method 400 may include at 420, locating the fuel filter outside of the fuel tank in a vertically mounted configuration and allowing for removing and replacing the fuel filter with a similarly configured fuel filter without opening the fuel tank, or disengaging the fuel tank from an engine compartment. In this way maintenance of the fuel system may be made easier, and may be relatively less expensive.

The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A diesel fuel conditioning system for a diesel engine comprising:

a fuel pump located within a fuel tank configured to pump fuel to the diesel engine; and a fuel filter located outside of the fuel tank operatively located upstream of a flow of fuel from the fuel pump.

2. The diesel fuel conditioning system of claim 1, wherein the fuel pump is a low pressure fuel pump and is located on a clean side of the filter.

3. The diesel fuel conditioning system of claim 1, further comprising a pressure chamber located at an outlet of the fuel pump and having a bleed orifice configured to bleed air from the flow of fuel.

4. The diesel fuel conditioning system of claim 1, further comprising a vacuum chamber located at an inlet of the fuel pump having a negative pressure relative to the fuel filter to pull the flow of fuel from the fuel filter into the vacuum chamber.

5. A diesel fuel conditioning system for a diesel engine comprising:

a fuel tank;

a fuel filter located outside of the fuel tank; and a vacuum chamber coupled with a pressure chamber via a fuel pump located within the fuel tank, the fuel pump configured to pull fuel from the fuel tank through the fuel filter and into the vacuum chamber.

6. The diesel fuel conditioning system of claim 5, wherein the fuel pump is further configured to direct fuel to the diesel engine via the pressure chamber, the pressure chamber having a bleed orifice configured to bleed air from the fuel which passes through the pressure chamber.

7. The diesel fuel conditioning system of claim 5, further comprising a fuel path wherein the fuel is directed from the engine via a fuel return passage into the fuel tank, then directed out of the fuel tank through the fuel filter and into the vacuum chamber.

8. The diesel fuel conditioning system of claim 7, wherein the fuel path includes a branch coupled with the fuel return passage where the fuel is able to be directed through the fuel filter before being directed to the vacuum chamber.

9. A diesel fuel conditioning arrangement of a diesel engine comprising:

a fuel tank;

a fuel filter located outside of the fuel tank; and a pump located inside the fuel tank and configured to pull fuel through the fuel filter and into the fuel tank, and to direct the fuel to the diesel engine.

10. The diesel fuel conditioning arrangement of claim 9, further comprising a vacuum chamber located at an inlet of the pump and a pressure chamber located at an outlet of the pump, the pressure chamber configured to dampen vibrations of the pump.

11. The diesel fuel conditioning arrangement of claim 9, further comprising a pressure chamber located at an outlet of the pump, the pressure chamber having a passage for directing the fuel to the diesel engine and an air bleed orifice configured to allow air to be expelled from the pressure chamber such that the expelled air is not directed to the diesel engine.

12. The diesel fuel conditioning arrangement of claim 11, wherein the expelled air is at least partly used to power a jet pump.

13. The diesel fuel conditioning arrangement of claim 9, further comprising a fuel reservoir located inside the fuel tank, the pump located substantially within the fuel reservoir, a vacuum chamber located at an inlet of the pump and a pressure chamber located at an outlet of the pump, a filter outlet passage configured to allow fuel to pass from the filter to the vacuum chamber, a filter inlet passage configured to allow fuel to pass from the fuel reservoir into the filter.

14. The diesel fuel conditioning arrangement of claim 13, an umbrella valve located in a wall of the fuel reservoir and configured to regulate a difference in pressure between the reservoir and the inside of the fuel tank and to selectively allow fuel to pass there between.

15. The diesel fuel conditioning arrangement of claim 9, further comprising a fuel recirculation valve configured to selectively direct at least a portion of fuel returned from the engine to the filter.

16. The diesel fuel conditioning arrangement of claim 9, wherein the pump is a low pressure pump on the clean side of the fuel filter, and the fuel filter can be removed and replaced with a similarly configured fuel filter without opening the fuel tank or disengaging the fuel tank from an engine compartment.

17. The diesel fuel conditioning arrangement of claim 16, wherein the pump is vertically mounted.

18. The diesel fuel conditioning arrangement of claim 9, wherein the fuel filter includes a water reservoir configured to collect water from the fuel that passes through the filter.

19. The diesel fuel conditioning arrangement of claim 9, wherein the fuel filter is a box filter.

20. The diesel fuel conditioning arrangement of claim 9, wherein the fuel filter is substantially cylindrically shaped.

21. A method for a fuel conditioning module of a diesel engine, comprising:

directing fuel via a pump located inside a fuel tank from inside of the fuel tank through a fuel filter located outside of the fuel tank and upstream of a flow of fuel from the fuel pump into a vacuum chamber positioned inside the fuel tank, before directing the fuel to the diesel engine.

22. The method of claim 21, further comprising:

configuring the pump to form a vacuum in the vacuum chamber in order to draw fuel from the filter into the vacuum chamber; and directing fuel from the vacuum chamber into a pressure chamber and then directing the fuel from the pressure chamber to the diesel engine.

23. The method of claim 21, further comprising locating the fuel filter outside of the fuel tank in a vertically mounted configuration and allowing for removing and replacing the fuel filter with a similarly configured fuel filter without opening the fuel tank, or disengaging the fuel tank from an engine compartment.

* * * * *